US008720763B2

(12) United States Patent
Kuehn et al.

(10) Patent No.: US 8,720,763 B2
(45) Date of Patent: May 13, 2014

(54) ANIMATED TAPE DISPENSER

(75) Inventors: Thomas P. Kuehn, St. Louis Park, MN (US); Stacy L. Abel, Maple Grove, MN (US); Vân Hong Tran Monnier, Eden Prairie, MN (US)

(73) Assignee: Target Brands, Inc., Minneapolis, MN (US)

( * ) Notice: Subject to any disclaimer, the term of this patent is extended or adjusted under 35 U.S.C. 154(b) by 155 days.

(21) Appl. No.: 13/149,236

(22) Filed: May 31, 2011

(65) Prior Publication Data

US 2012/0305617 A1 Dec. 6, 2012

(51) Int. Cl.
*B26F 3/02* (2006.01)

(52) U.S. Cl.
USPC ..... 225/39; 225/77; 242/588.6

(58) Field of Classification Search
USPC ..... 225/77, 56, 39, 25, 46; D19/69; 33/758; 242/588.6, 588.2, 588.3
See application file for complete search history.

(56) References Cited

U.S. PATENT DOCUMENTS

| | | | | |
|---|---|---|---|---|
| 2,071,225 | A | | 2/1937 | Buttigieg |
| D111,796 | S | | 10/1938 | Savage |
| D144,096 | S | | 3/1946 | Boyajian |
| D170,494 | S | | 9/1953 | Darroch |
| D185,415 | S | | 6/1959 | Doe et al. |
| D191,246 | S | | 8/1961 | Belbow |
| D197,934 | S | | 4/1964 | Weaver |
| D226,208 | S | | 1/1973 | Meyers et al. |
| D246,659 | S | | 12/1977 | Vailati |
| D261,165 | S | | 10/1981 | Kurosawa et al. |
| D274,825 | S | | 7/1984 | Lissoni |
| D295,424 | S | * | 4/1988 | Porter ..... D19/67 |
| D326,475 | S | | 5/1992 | Alexander |
| D338,041 | S | | 8/1993 | Cheng |
| 5,318,469 | A | | 6/1994 | Unalp et al. |
| 5,391,106 | A | | 2/1995 | Lidert, Jr. |
| D397,602 | S | | 9/1998 | Kim |
| D416,592 | S | | 11/1999 | Leadbetter |
| 5,996,932 | A | * | 12/1999 | Wang ..... 242/598.5 |
| 6,004,185 | A | * | 12/1999 | Rehkemper et al. ..... 446/317 |
| D435,594 | S | | 12/2000 | Polidoro |
| 6,386,261 | B1 | * | 5/2002 | Sieber et al. ..... 156/577 |
| 6,429,851 | B1 | * | 8/2002 | Vaghefi et al. ..... 345/163 |
| 6,460,800 | B1 | | 10/2002 | Watanabe et al. |
| D500,175 | S | | 12/2004 | Hood |
| D523,084 | S | | 6/2006 | Wojtkun et al. |
| D571,405 | S | | 6/2008 | Boulais |
| 7,676,948 | B2 | | 3/2010 | Miles |
| 2006/0076384 | A1 | * | 4/2006 | Dickie ..... 225/39 |

(Continued)

OTHER PUBLICATIONS

Vat19, "Frog Tape Dispenser," pp. 1-3, http://www.vat19.com/dvds/frog-tape-dispenser.cfm (last visited on Oct. 12, 2010).

(Continued)

*Primary Examiner* — Omar Flores Sanchez
(74) *Attorney, Agent, or Firm* — Leanne Taveggia Farrell; Westman, Champlin & Koehler, P.A.

(57) ABSTRACT

A tape dispenser includes a housing having an outer surface and is configured to contain a roll of adhesive tape. Coupled to the outer surface of the housing includes features of an animal including at least one animal leg coupled to the housing and extending outwardly from the outer surface of the housing. The at least one animal leg moves relative to and along the outer surface of the housing upon adhesive tape being dispensed from the roll of adhesive tape.

20 Claims, 23 Drawing Sheets

(56) References Cited

U.S. PATENT DOCUMENTS

| | | | | |
|---|---|---|---|---|
| 2008/0067211 | A1* | 3/2008 | Steele et al. | 225/77 |
| 2009/0078733 | A1* | 3/2009 | Yagyu | 225/77 |

OTHER PUBLICATIONS

Office Action from Canadian Patent Application No. 2,762,221, mailed May 7, 2012 (4 pages).

* cited by examiner

ANIMATED TAPE DISPENSER

BACKGROUND

A tape dispenser supports a spool of tape and includes a cutting surface for shearing the tape. An operator unrolls tape from the spool by pulling on its end, tears off the desired amount using the cutting surface and applies the tape to a job or project. While some tape dispensers are handheld units and can be disposable, other tape dispensers reside on a table top or desk top for permanent use.

The discussion above is merely provided for general background information and is not intended to be used as an aid in determining the scope of the claimed subject matter.

SUMMARY

A tape dispenser includes a housing having an outer surface and configured to contain a roll of adhesive tape. Coupled to the outer surface of the housing includes features of an animal including at least one animal leg coupled to the housing and extending outwardly from the outer surface of the housing. The at least one animal leg moves relative to and along the outer surface of the housing upon adhesive tape being dispensed from the roll of adhesive tape.

The roll of adhesive tape is mounted to a spool receiving assembly that includes a spool receiver, an axial member and at least one elongated member. The spool receiver has a central axis and is configured to receive the roll of adhesive tape. The axial member is rotatably coupled to the housing at first and second ends and is fixedly coupled to the spool receiver at the central axis. The at least one elongated member is fixedly coupled along the axial member between the spool receiver and one of the first and second ends of the axial member. The at least one elongated member has a first end and a second end, which are configured to engage with the at least one animal leg to slide the at least one animal leg from a first position along a channel opening in the housing to a second position along the channel opening.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
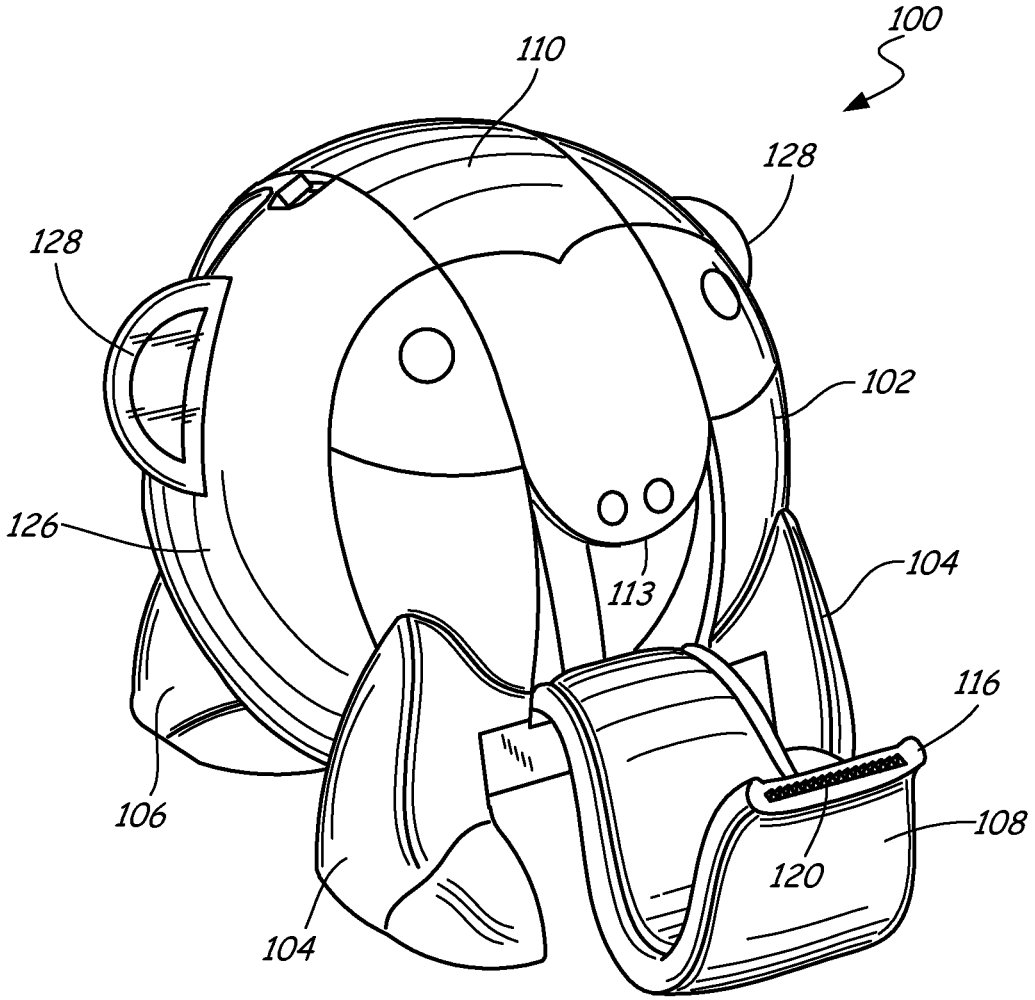
FIG. 1 illustrates a front perspective view of a tape dispenser in accordance with one embodiment.
Figure 2:
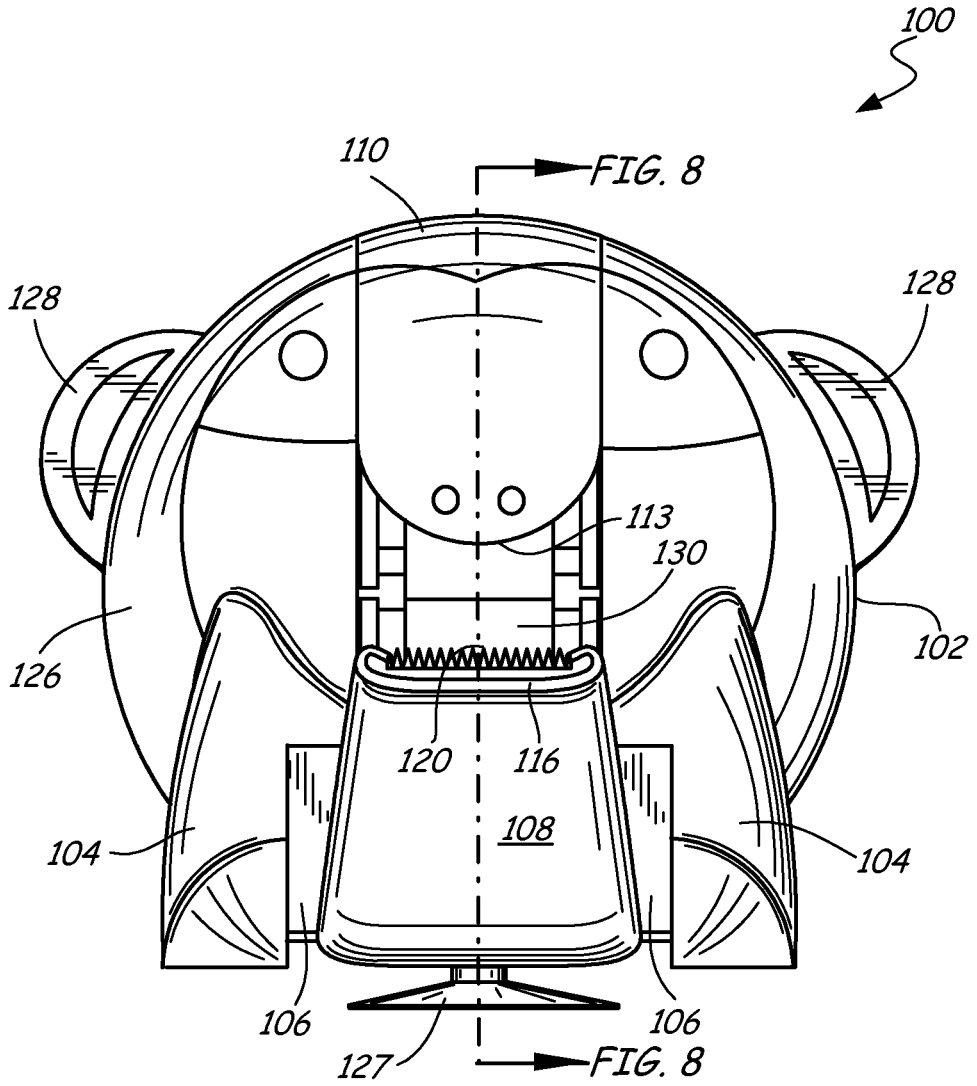
FIG. 2 illustrates a front elevation view of the tape dispenser of FIG. 1.
Figure 3:
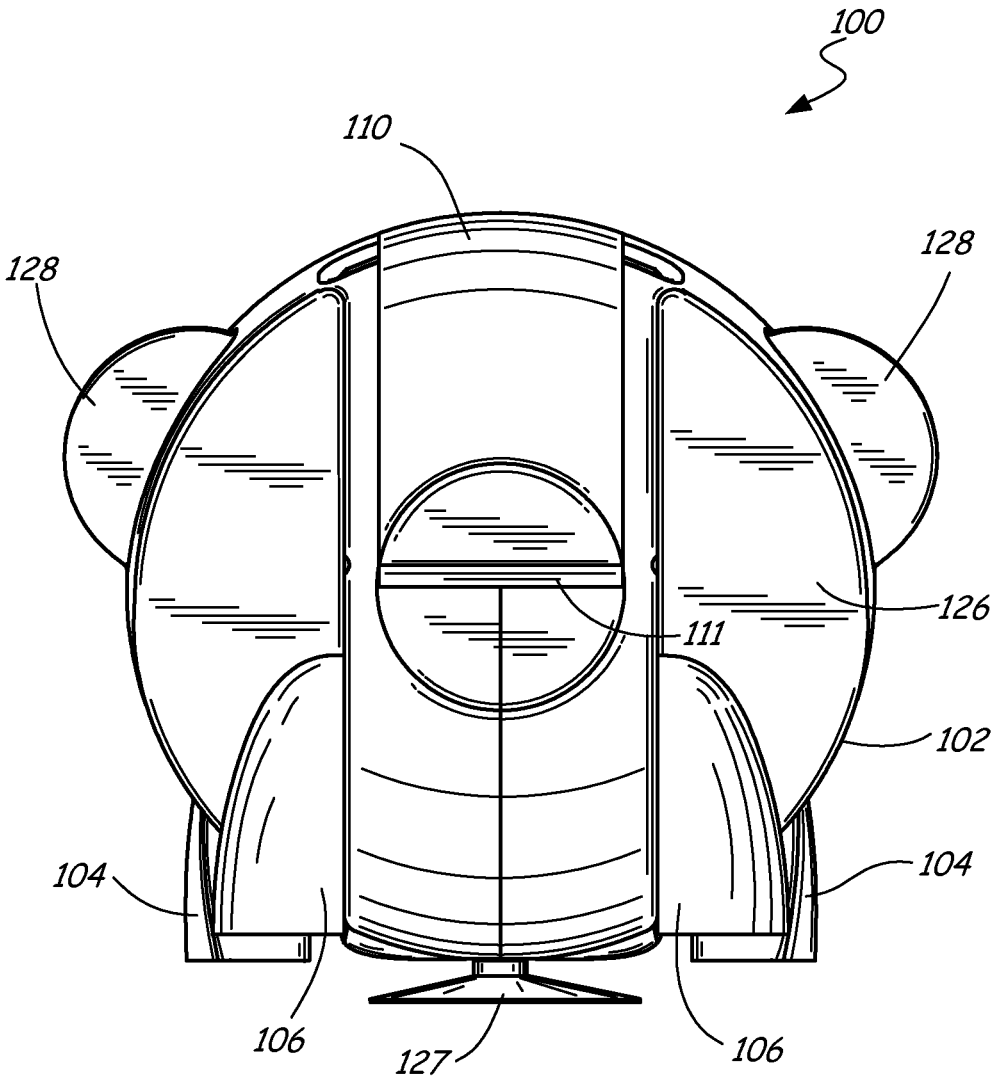
FIG. 3 illustrates a back elevation view of the tape dispenser of FIG. 1.

Embodiments are described as an animal-themed tape dispenser including a spool receiving assembly for receiving a spool of adhesive tape, a pair of animal legs coupled to a main body of the tape dispenser and capable of being actuated and a cutting surface for cutting the adhesive tape into pieces. The spool receiving assembly includes a pair of elongated support members configured to actuate the animal legs along a channel opening in the main body when tape is being dispensed or pulled from the spool of tape located in the tape dispenser.

FIGS. 1-8 illustrate various views of an animal-themed tape dispenser 100 in accordance with one embodiment. Tape dispenser 100 includes a spherical-shaped, hollow main body or housing 102. Main body 102 includes an interior or inner surface 124 (FIG. 8) and an exterior or outer surface 126. Exterior surface 126 includes decorative features of an animal head. More specifically and as illustrated in FIGS. 1-7, printed on exterior surface 126 includes decorative features of a monkey head. For example, printed decorative features may be facial features including, but not limited to, a pair of eyes and a nose. It should be realized that the terminology "animal head" and "monkey head" do not mean that exterior surface 126 of main body 102 includes features of a real animal head or real monkey head. Rather, "animal head" and "monkey head" contemplate ornamental or decorative features that simulate characteristics of an animal head and monkey head.

In the embodiment illustrated in FIGS. 1-8, while main body 102 includes decorative features of a monkey head printed on its exterior surface 126, additional decorative features of a monkey head are formed integrally with and extend outwardly from exterior surface 126 of main body 102. For example, animal-themed tape dispenser 100 also includes a pair of animal ears 128 formed integrally with and extending outwardly from exterior surface 126 of main body 102. It should be realized that the terminology "animal ears" does not mean that animal-themed tape dispenser 100 includes features of a real animal ears. Rather, "animal ears" contemplates ornamental or decorative features that simulate characteristics of animal ears.

Animal-themed tape dispenser 100 also includes other features as well as bodily features of a monkey including a pair of front animal legs 104, a pair of rear animal legs 106, an animal tongue 108 and an access door 110. It should be realized that the terminology "animal legs" and "animal tongue" do not mean that tape dispenser 100 includes features of real animal legs or a real animal tongue. Rather, "animal legs" and "animal tongue" contemplate ornamental, decorative or structural features that simulate characteristics of animal legs and an animal tongue.

The pair of front animal legs 104 are integrally formed with and extend outwardly from exterior surface 126. However, in other embodiments, front animal legs 104 can be coupled separately to main body 102. The pair of rear animal legs 106 are coupled to the main body 102 through a pair of channel openings 112 (FIGS. 4-5 and 8) and extend outwardly from exterior surface 126. The pair of rear animal legs 106 are configured to actuate or move along the channel openings 112 and relative to exterior surface 126 of main body 102 upon the dispensing of adhesive tape from animal-themed tape dispenser 100. Such a mechanism is described in detail in regards to FIGS. 19-23.

Tape dispenser 100 also includes a support mechanism 127. Support mechanism 127 is configured to support main body 102 and prevent the tape dispenser 100 from sliding on a surface of a table top or desk top when tape is being dispensed. In one embodiment, support mechanism 127 is a suction cup coupled to a bottom side of exterior surface 126. Other embodiments can include weighted components or the like for ensuring main body 102 remains in place when tape is dispensed.

Figure 4:
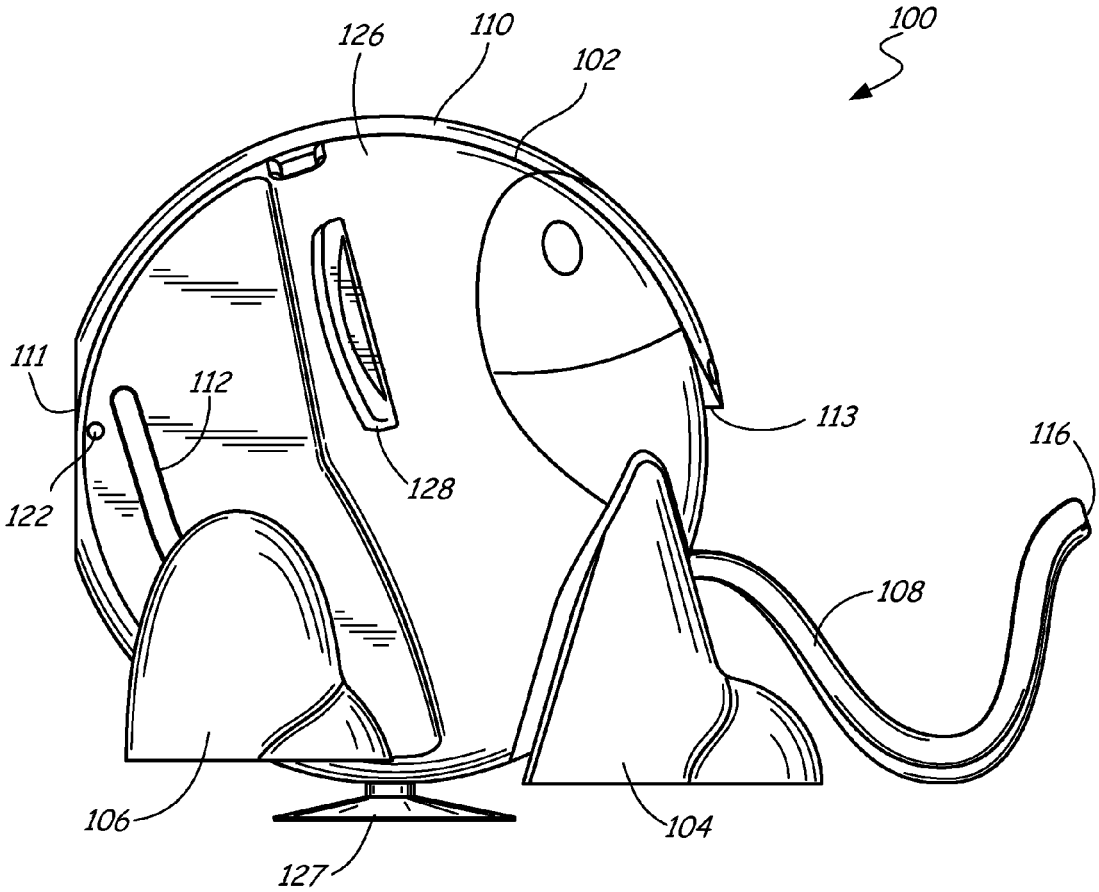
FIG. 4 illustrates a left side elevation view of the tape dispenser of FIG. 1.
Figure 5:
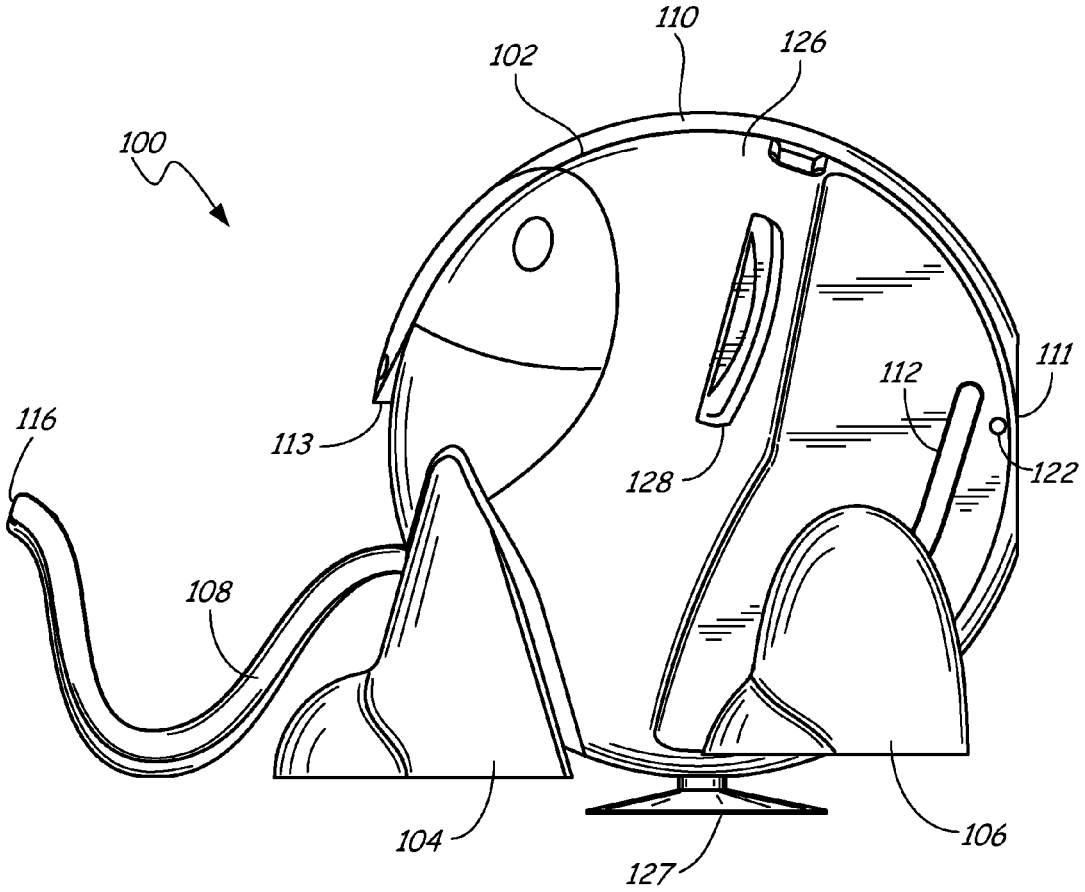
FIG. 5 illustrates a right sides elevation view of the tape dispenser of FIG. 1.
Figure 6:
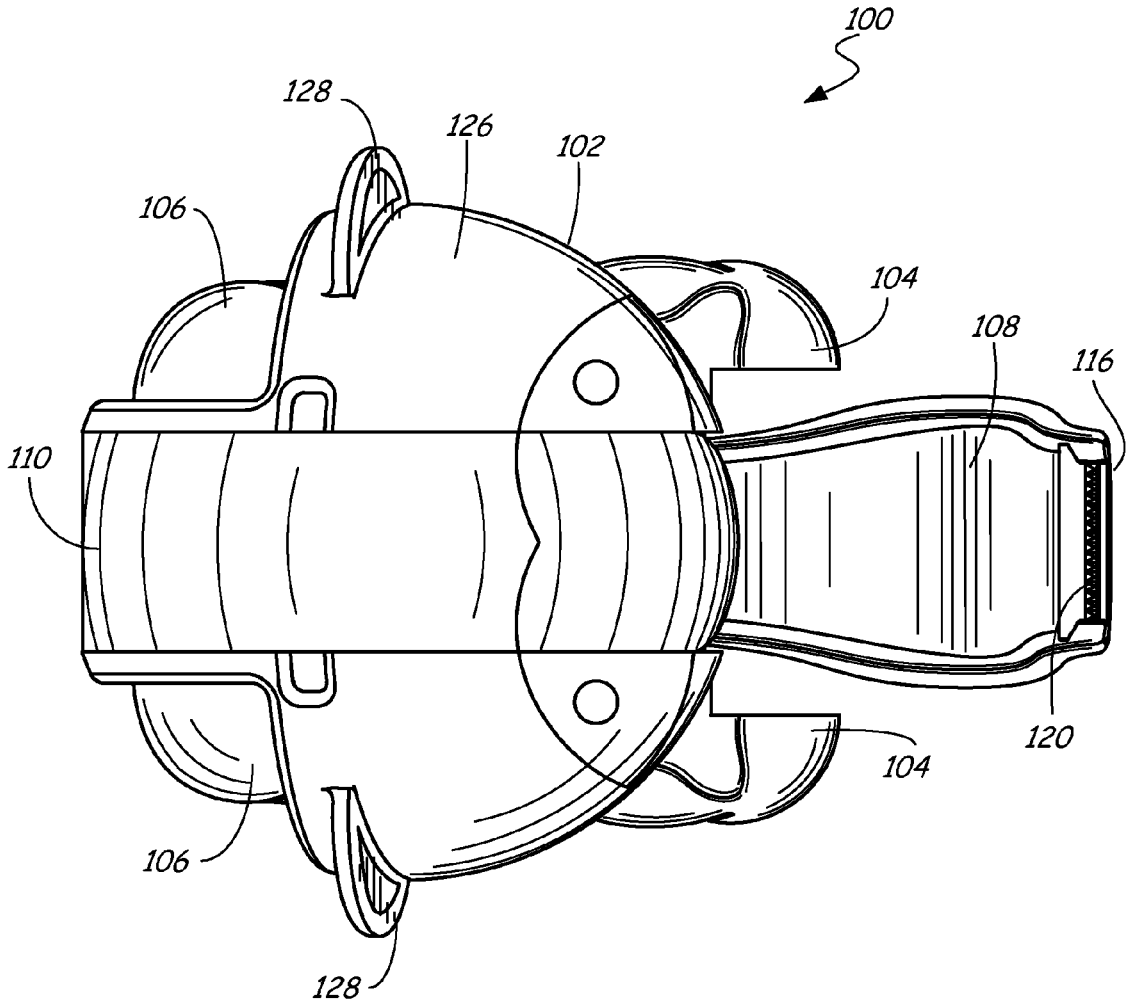
FIG. 6 illustrates a top elevation view of the tape dispenser of FIG. 1.
Figure 7:
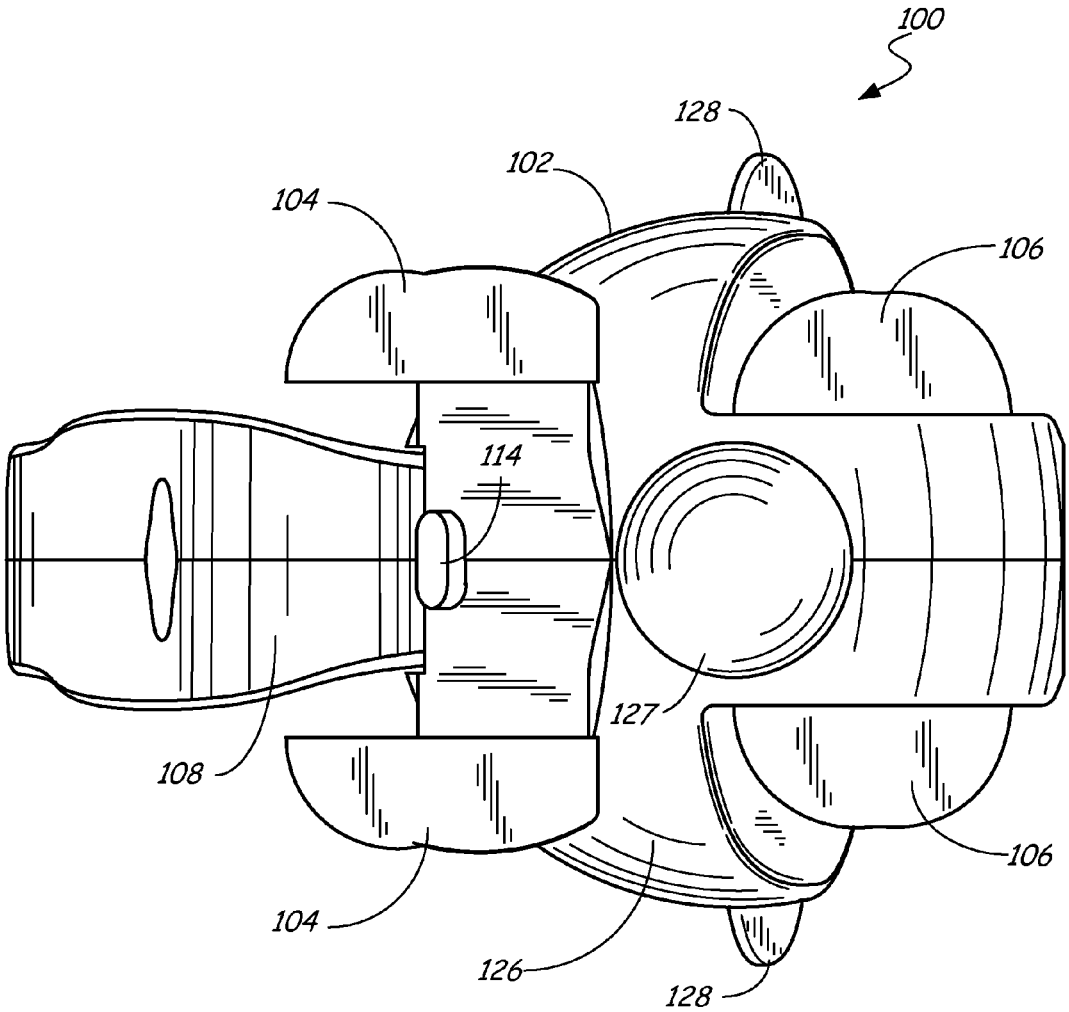
FIG. 7 illustrates a bottom elevation view of the tape dispenser of FIG. 1.

Animal tongue 108 includes a proximal end 114 (FIGS. 7 and 8) and a distal end 116. Proximal end 114 is coupled to main body 102 through an aperture 118 (FIG. 8) in main body 102. Distal end 116 includes a cutting surface 120. The access door 110 includes a proximal end 111 and a distal end 113. The proximal end 111 of access door 110 is pivotally coupled to main body 102 about a pivot axis 122 (FIGS. 4, 5 and 8).

Figure 8:
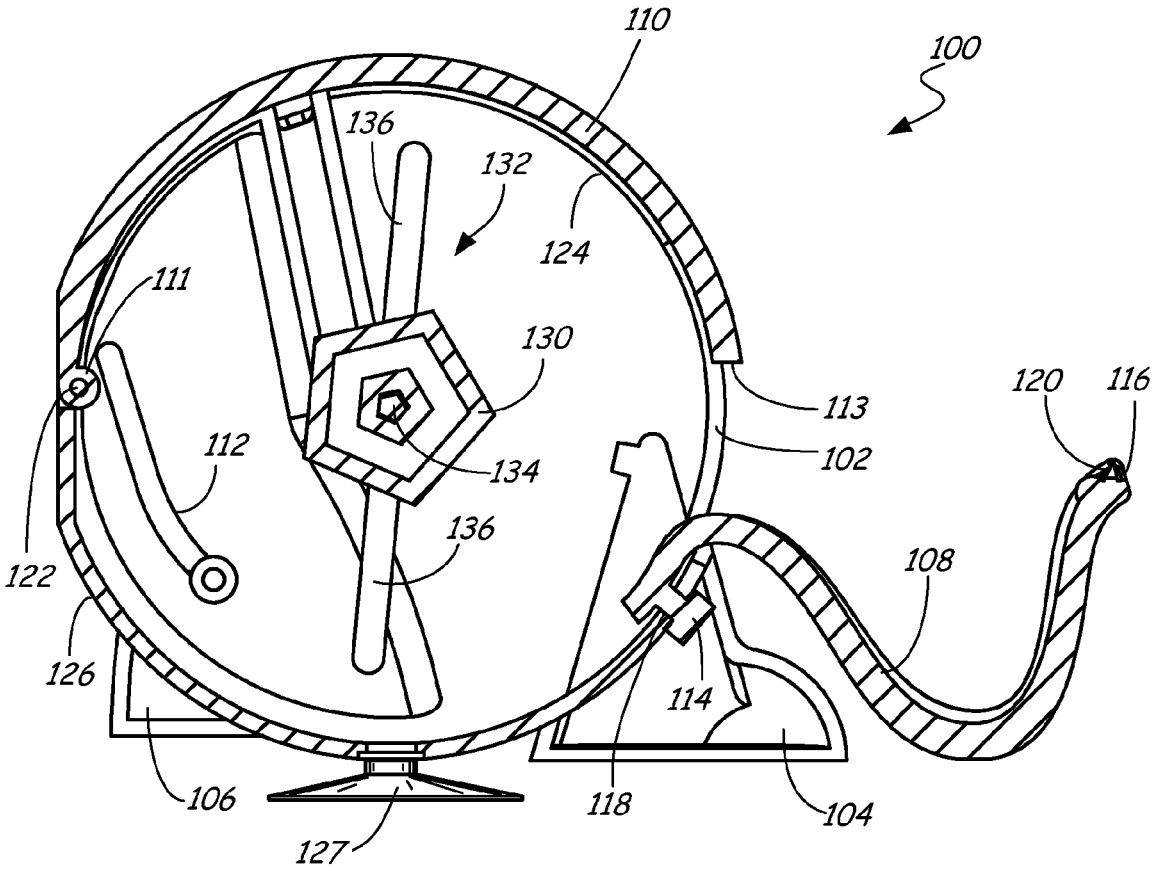
FIG. 8 illustrates a section view of the tape dispenser of FIG. 1 as denoted in FIG. 2.
Figure 9:
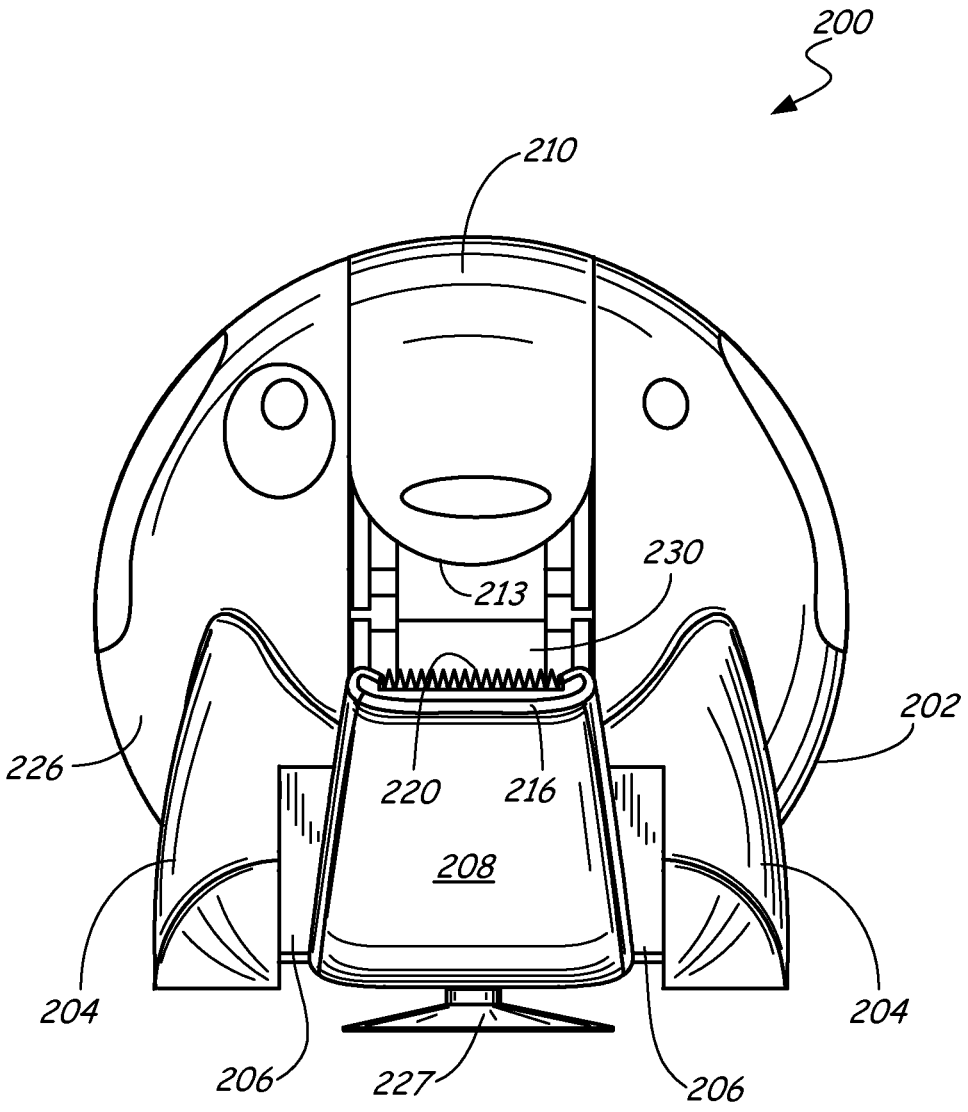
FIG. 9 illustrates a front elevation view of a tape dispenser in accordance with another embodiment.
Figure 10:
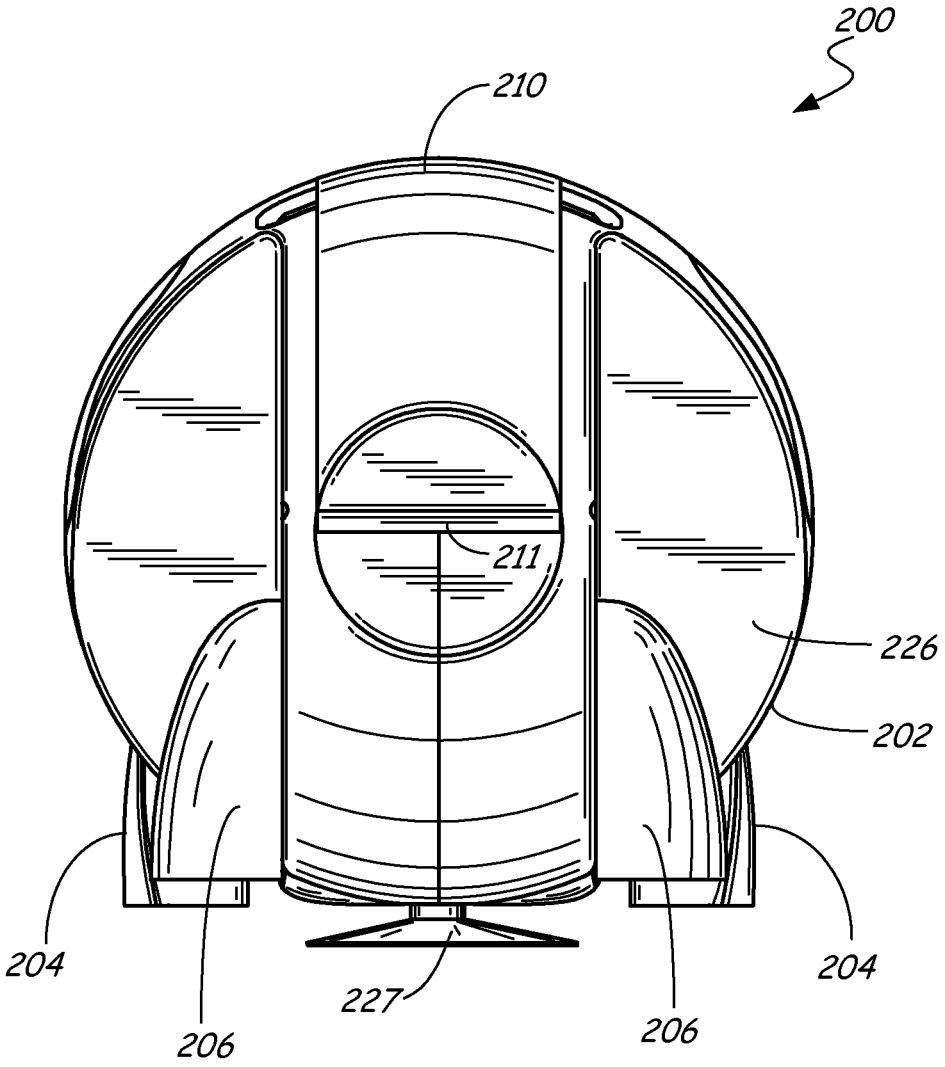
FIG. 10 illustrates a back elevation view of the tape dispenser of FIG. 9.

As illustrated in detail in the section view of FIG. 8, animal-themed tape dispenser 100 includes a spool receiving assembly 132. Spool receiving assembly 132 includes a spool receiver 130 (FIGS. 2 and 8), an axial member 134 and at least one elongated member 136. Spool receiver 130 is configured to be loaded with a spool or roll of adhesive tape material (not illustrated in FIG. 8). The spool receiving assembly 132 is inserted into main body 102 through access door 110 and coupled to interior surface 124. Therefore, spool receiving assembly 132 is located within the hollow interior of main body 102.

The dispensing of adhesive tape material from the spool is performed through an opening in the main body 102 located below distal end 113 of access door 110 and located above the proximal end 114 of animal tongue 108. Pieces of adhesive tape are cut from the spool using cutting surface 120 located on distal end 116 of animal tongue 108.

FIGS. 9-13 illustrate various views of an animal-themed tape dispenser 200 in accordance with another embodiment. Like tape dispenser 100, tape dispenser 200 includes a spherical-shaped, hollow main body or housing 202. Main body 202 includes an interior or inner surface (not illustrated in FIGS. 9-13) and an exterior or outer surface 226. Exterior surface 226 includes decorative features of an animal head. More specifically and as illustrated in FIGS. 9-13, printed on exterior surface 226 includes decorative features of a dog head. For example, printed decorative features may be features including, but not limited to, a pair of eyes, a nose, a spot and a pair of ears. It should be realized that the terminology "animal head" and "dog head" do not mean that exterior surface 226 of main body 202 includes features of a real animal head or a real dog head. Rather, "animal head" and "dog head" contemplate ornamental or decorative features that simulate characteristics of an animal head and dog head.

Like animal-themed tape dispenser 100, animal-themed tape dispenser 200 also includes other features as well as bodily features of a dog including a pair of front animal legs 204, a pair of rear animal legs 206, an animal tongue 208 and an access door 210. The pair of front animal legs 204 are integrally formed with and extend outwardly from exterior surface 226. However, in other embodiments, front animal legs 204 can be coupled separately to main body 202. The pair of rear animal legs 206 are coupled to main body 202 through a pair of channel openings 212 (FIGS. 11 and 12) and extend outwardly from exterior surface 126. The pair of rear animal legs 206 are configured to actuate or move along the channel openings 212 and relative to the exterior surface 226 of main body 102 upon the dispensing of adhesive tape from animal-themed tape dispenser 200. Such a mechanism is described in detail below in regards to FIGS. 19-23.

Tape dispenser 200 also includes a support mechanism 227. Support mechanism 227 is configured to support main body 202 and prevent the tape dispenser 200 from sliding on a surface of a table top or desk top when tape is being dispensed. In one embodiment, support mechanism 227 is a suction cup coupled to a bottom side of exterior surface 226. Other embodiments can include weighted components or the like for ensuring main body 202 remains in place when tape is dispensed.

Figure 11:
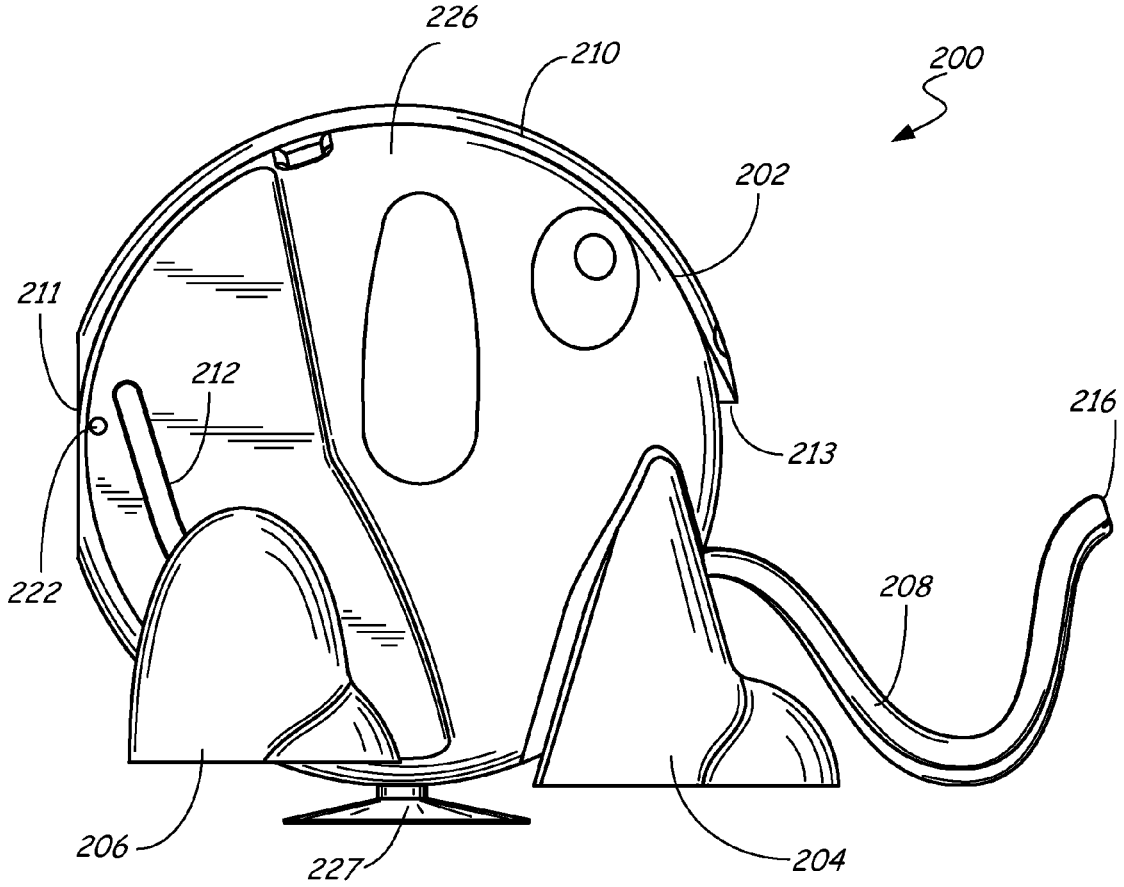
FIG. 11 illustrates a left side elevation view of the tape dispenser of FIG. 9.
Figure 12:
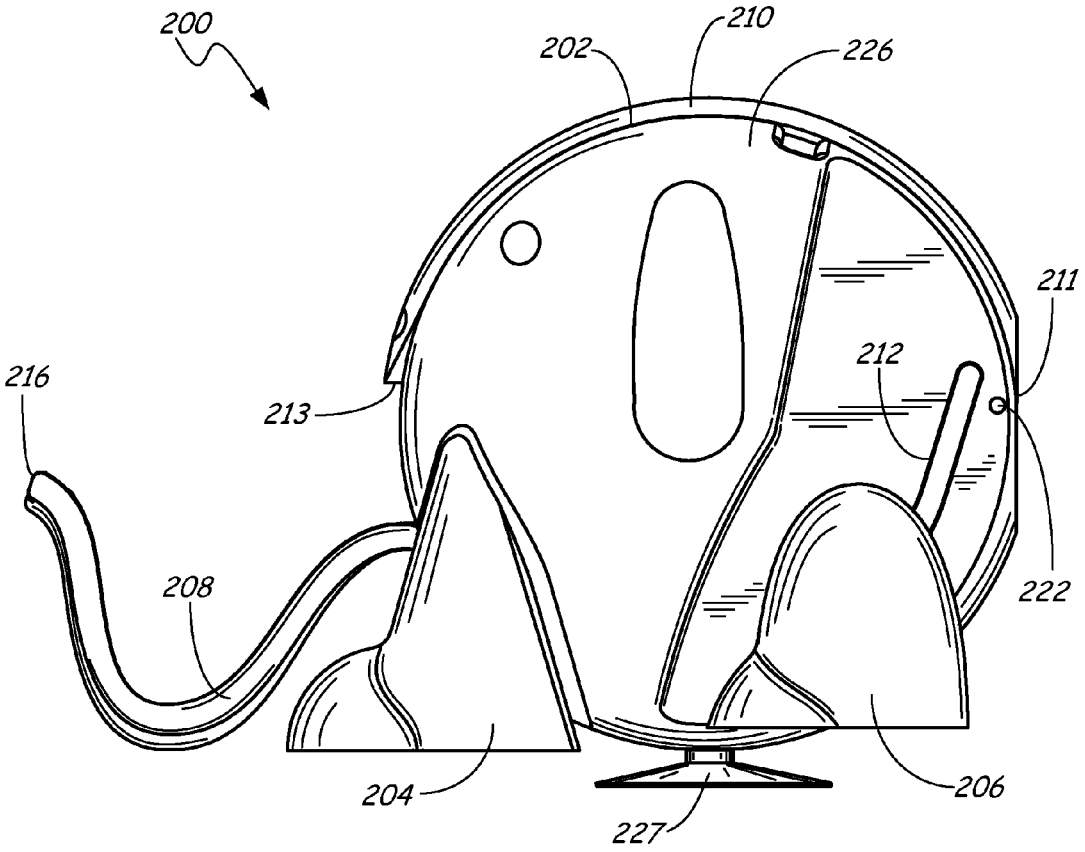
FIG. 12 illustrates a right side elevation view of the tape dispenser of FIG. 9.
Figure 13:
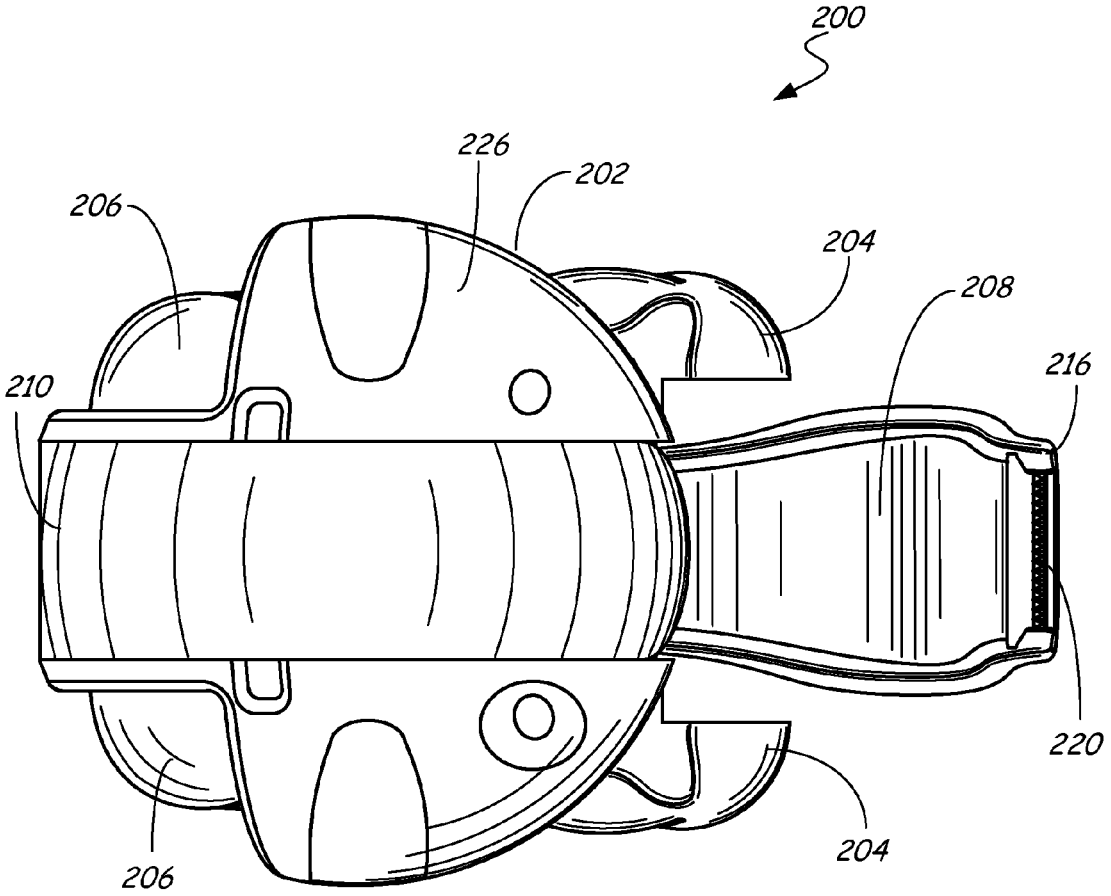
FIG. 13 illustrates a top elevation view of the tape dispenser of FIG. 9.
Figure 14:
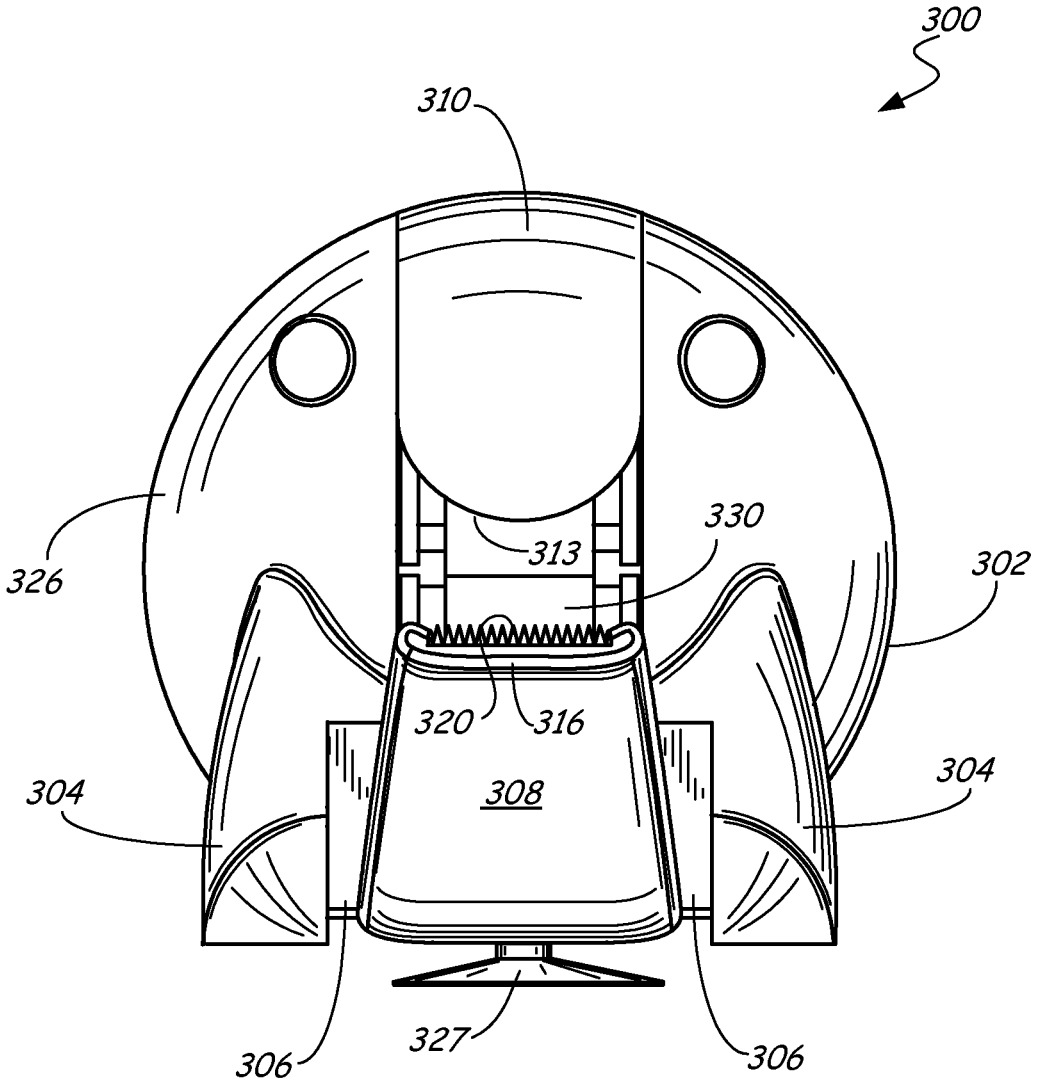
FIG. 14 illustrates a front elevation view of a tape dispenser in accordance with yet another embodiment.
Figure 15:
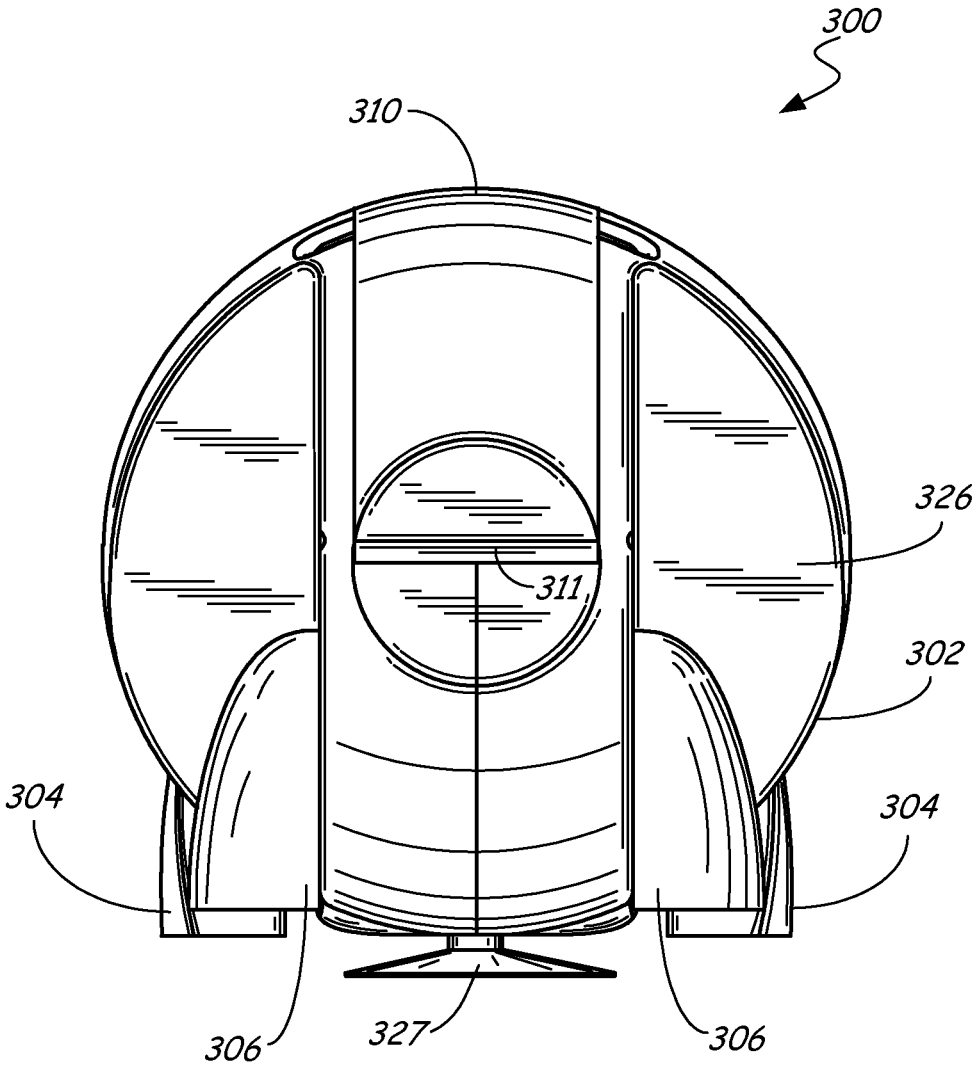
FIG. 15 illustrates a back elevation view of the tape dispenser of FIG. 14.

Animal tongue 208 includes a proximal end (not illustrated in FIGS. 9-13) and a distal end 216. The proximal end is coupled to main body 202 through an aperture (not illustrated in FIGS. 9-13) in main body 202. Distal end 216 includes a cutting surface 220. The access door 210 includes a proximal end 211 and a distal end 213. The proximal end 211 of access door 210 is pivotally coupled to main body 202 about a pivot axis 222 (FIGS. 11 and 12).

Animal-themed tape dispenser 200 also includes a spool receiving assembly. Spool receiving assembly includes a spool receiver 230 (FIG. 9), an axial member and at least one elongated member. Spool receiver 230 is configured to be loaded with a spool or roll of adhesive tape material (not illustrated in FIGS. 9-13). The spool receiving assembly is inserted into main body 202 through access door 210 and is coupled to the interior surface. Therefore, the spool receiving assembly is located within the hollow interior of main body 202.

The dispensing of adhesive tape material from the spool is performed through an opening in the main body 202 located below distal end 213 of access door 210 and located above the proximal end of animal tongue 208. Pieces of adhesive tape are cut from the spool using cutting surface 220 located on distal end 216 of animal tongue 208.

FIGS. 14-18 illustrate various views of an animal-themed tape dispenser 300 in accordance with yet another embodiment. Like tape dispensers 100 and 200, tape dispenser 300 includes a spherical-shaped, hollow main body or housing 302. Main body 302 includes an interior or inner surface (not illustrated in FIGS. 14-18) and an exterior or outer surface 326. Exterior surface 326 includes decorative features of an animal head. More specifically and as illustrated in FIGS. 14-18, printed on exterior surface 326 includes decorative features of a frog head. For example, printed decorative features may be features including, but not limited to, a pair of eyes. It should be realized that the terminology "animal head" and "frog head" do not mean that exterior surface 326 of main body 302 includes features of a real animal head or a real frog head. Rather, "animal head" and "frog head" contemplate ornamental or decorative features that simulate characteristics of an animal head and frog head.

Like animal-themed tape dispensers 100 and 200, animal-themed tape dispenser 300 also includes other features as well as bodily features of a frog including a pair of front animal legs 304, a pair of rear animal legs 306, an animal tongue 308 and an access door 310. The pair of front animal legs 304 are integrally formed with and extend outwardly from exterior surface 326 and are configured to support the main body 302. However, in other embodiments, front animal legs 304 can be coupled separately to main body 302. The pair of rear animal legs 306 are coupled to the main body 302 through a pair of channel openings 312 (FIGS. 16 and 17) and extend outwardly from exterior surface 326. The pair of rear animal legs 306 are configured to actuate or move along the channel openings 312 and relative to the exterior surface 326 of main body 302 upon the dispensing of adhesive tape from animal-themed tape dispenser 300. Such a mechanism is described in detail below in regards to FIGS. 19-23.

Tape dispenser 300 also includes a support mechanism 327. Support mechanism 327 is configured to support main body 302 and prevent the tape dispenser 300 from sliding on a surface of a table top or desk top when tape is being dispensed. In one embodiment, support mechanism 327 is a suction cup coupled to a bottom side of exterior surface 326. Other embodiments can include weighted components or the like for ensuring main body 302 remains in place when tape is dispensed.

Figure 16:
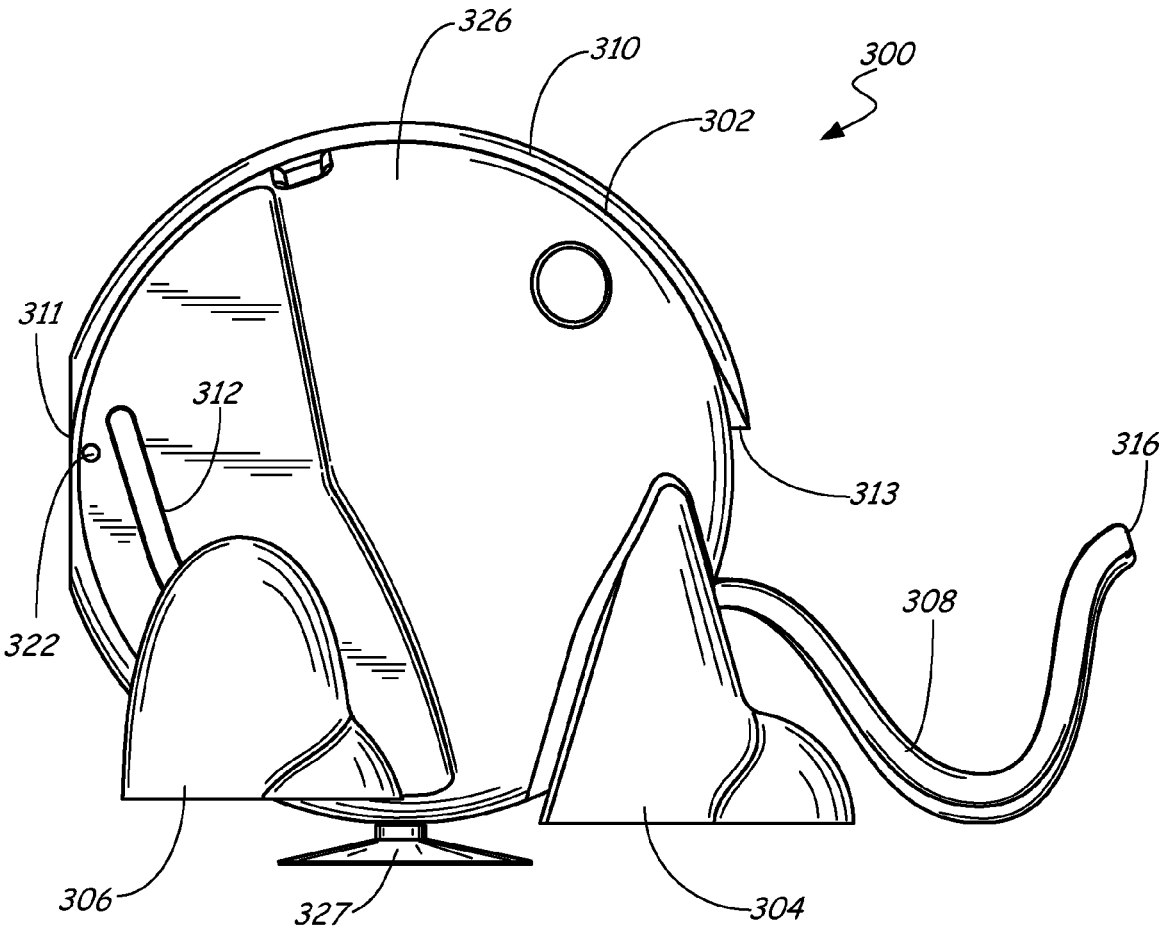
FIG. 16 illustrates a left side elevation view of the tape dispenser of FIG. 15.
Figure 17:
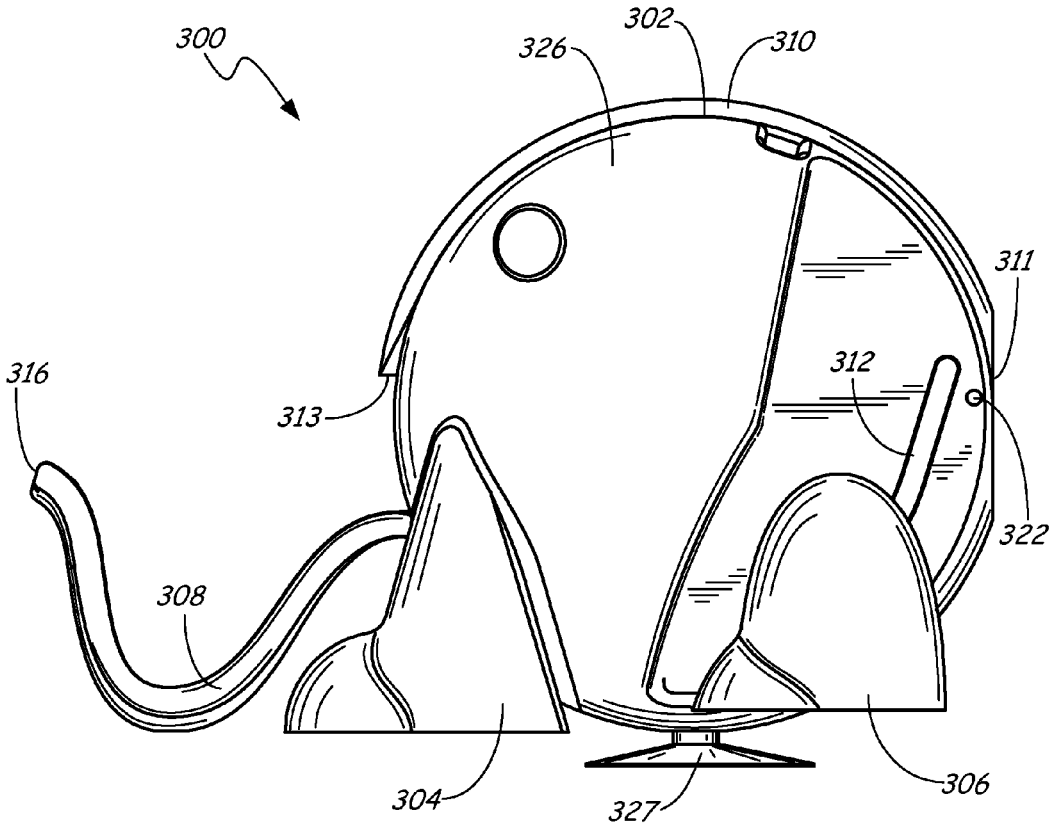
FIG. 17 illustrates a right side elevation view of the tape dispenser of FIG. 15.
Figure 18:
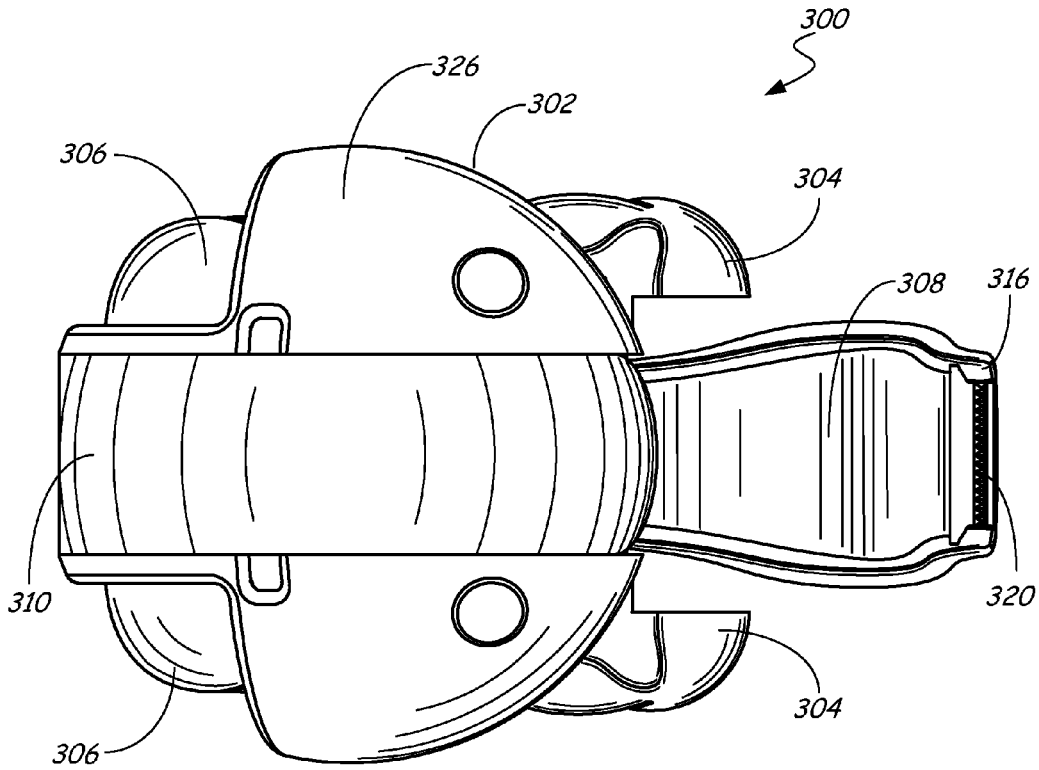
FIG. 18 illustrates a top elevation view of the tape dispenser of FIG. 15.

Animal tongue 308 includes a proximal end (not illustrated in FIGS. 14-18) and a distal end 316. The proximal end is coupled to main body 302 through an aperture (not illustrated in FIGS. 14-18) in main body 302. Distal end 316 includes a cutting surface 320. The access door 310 includes a proximal end 311 and a distal end 313. The proximal end 311 of access door 310 is pivotally coupled to main body 302 about a pivot axis 322 (FIGS. 16 and 17).

Animal-themed tape dispenser 300 also includes a spool receiving assembly. The spool receiving assembly includes a spool receiver 330 (FIG. 14), an axial member and at least one elongated member. Spool receiver 330 is configured to be loaded with a spool or roll of adhesive tape material (not illustrated in FIGS. 14-18). The spool receiving assembly is inserted into main body 302 through access door 310 and coupled to the interior surface. Therefore, the spool receiving assembly is located within the hollow interior of main body 302.

The dispensing of adhesive tape material from the spool is performed through an opening in the main body 302 located below distal end 313 of access door 310 and located above the proximal end of animal tongue 308. Pieces of adhesive tape are cut from the spool using cutting surface 320 located on distal end 316 of animal tongue 308.

Figure 19:
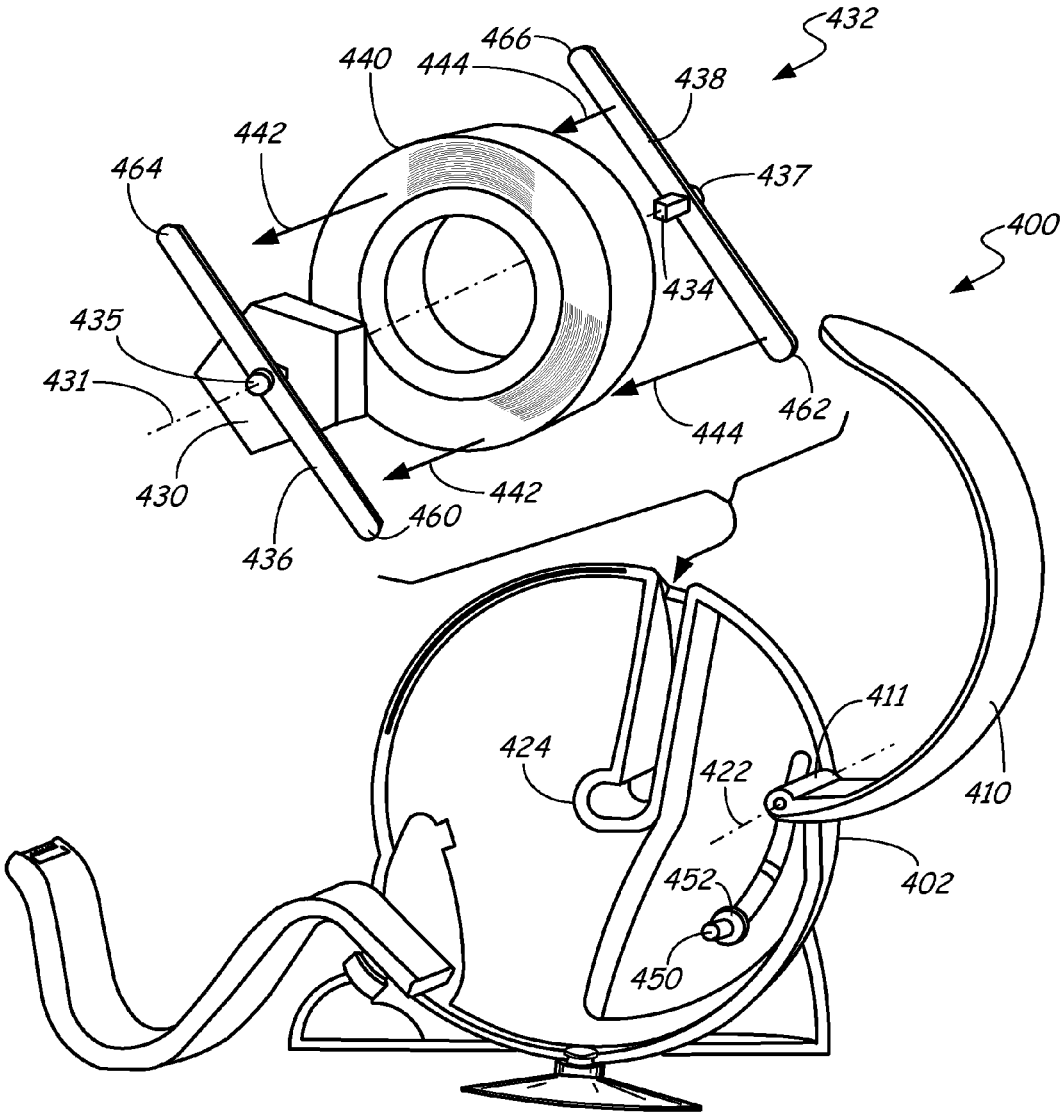
FIGS. 19-21 illustrate section views of a spool receiving assembly for use in supporting and inserting a spool of tape into a tape dispenser.
Figure 20:
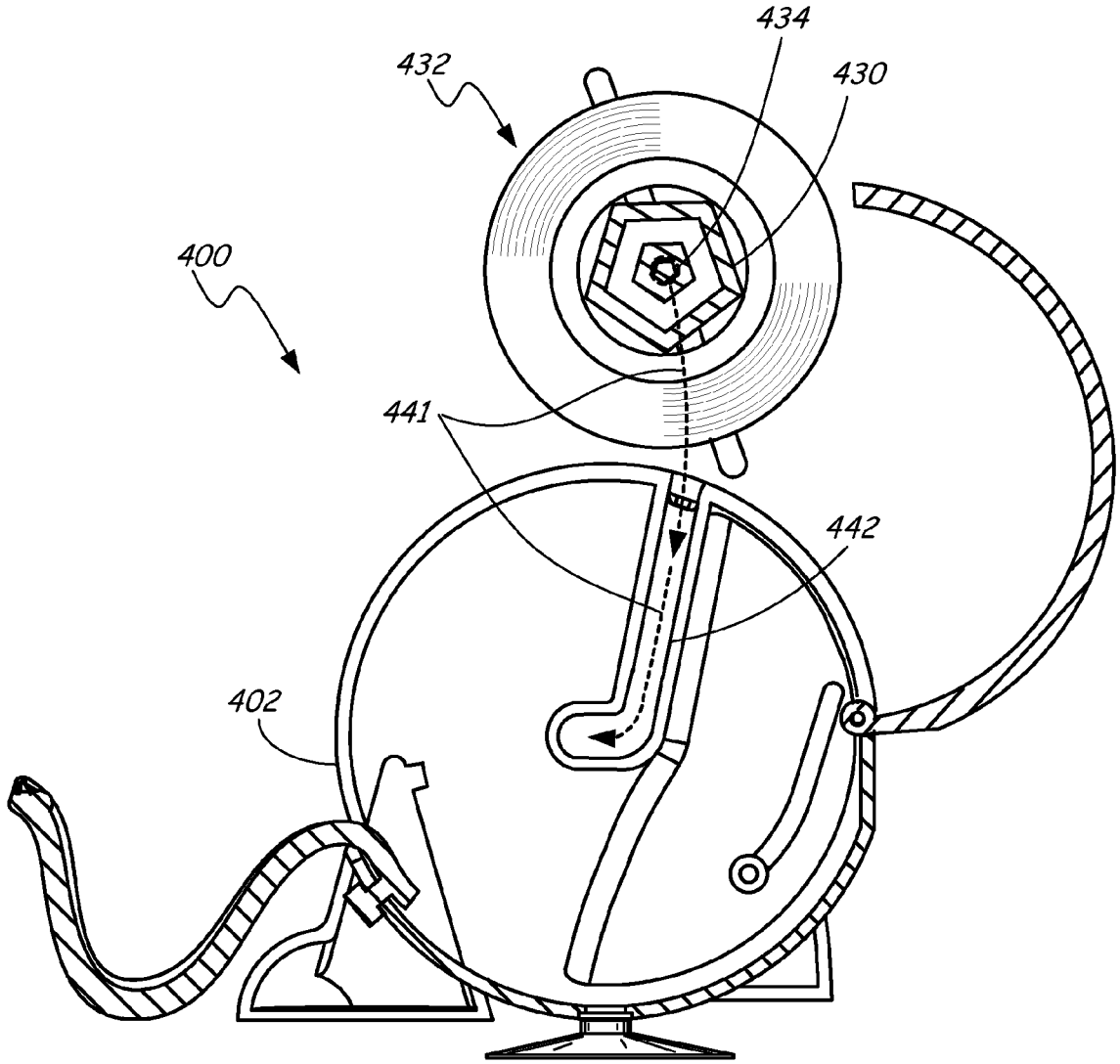
Figure 21:
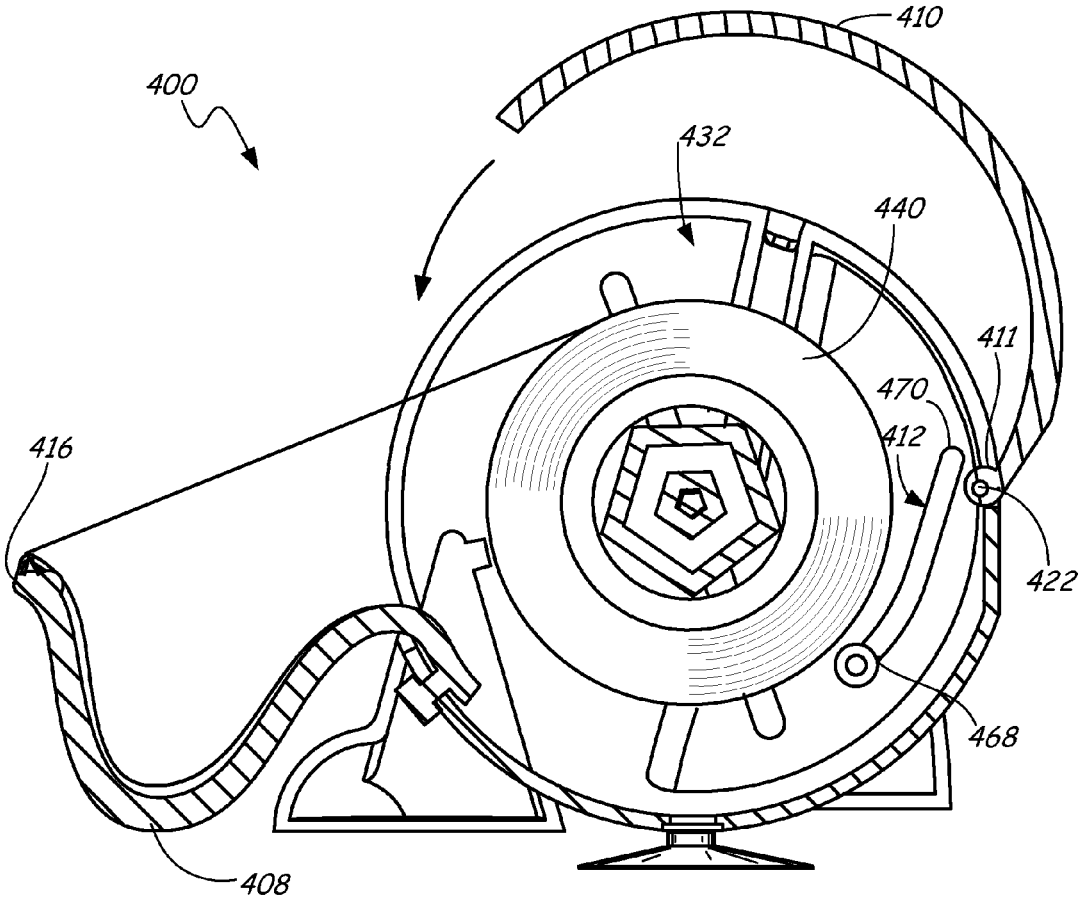

FIGS. 19-21 illustrate section views of a spool receiving assembly 432 for inserting a spool or roll of tape into an animal-themed tape dispenser 400. Spool receiving assembly 432 (as mentioned above in the embodiments illustrated in FIGS. 1-18) includes a spool receiver 430, an axial member 434 and a pair of elongated members 436 and 438. Spool receiver 430 includes a central axis 431 and is configured to receive spool of adhesive tape 440. Axial member 434 includes first and second ends 435 and 437. Axial member 434 is fixedly coupled to spool receiver 430 at central axis 431 and rotatably coupled to an interior surface 424 of main body or housing 402 of tape dispenser 400 at first and second ends 435 and 437. Each of the pair of elongated members 436 and 438 are fixedly coupled along axial member 434 adjacent spool receiver 430. More specifically, each of the pair of elongated members 436 and 438 are fixedly coupled along axial member 434 between spool receiver 430 and one of the first and second ends 435 and 437 of axial member 434. The pair of elongated members 436 and 438 having first ends 460 and 462 and second ends 464 and 466.

As illustrated in FIG. 19, proximal end 411 of access door 410 of tape dispenser 400 is rotated about a pivotal axis 422 to open access door 410. As illustrated by the first set of directional arrows 442, spool of adhesive tape 440 is mounted to spool receiver 430. As illustrated by the second set of directional arrows 444, second elongated member 438 is coupled to spool receiver 430, which is coupled to first elongated member 436, via axial member 434. First elongated member 436 and second elongated member 438 support the spool of adhesive tape 440. While FIG. 19 illustrates first and second elongated members 436 and 438 as being aligned with each other, the first and second elongated members may alternatively be angularly offset from each other.

As illustrated by directional arrows 441 in FIG. 20, the opposing ends 435 and 437 of axial member 434 are inserted into a pair of spool support grooves 442 (of which only one is illustrated in the section views) for loading the spool of adhesive tape 440 into the hollow interior of main body 402 of the animal-themed tape dispenser 400. After loading, an end of the tape is pulled from the spool of adhesive tape 440 for dispensing. In particular and in FIG. 21, the last cut edge of the tape is placed on distal end 416 of animal tongue 408 for continued use. After loading and pulling the end of the tape, proximal end 411 of access door 410 is rotated about pivotal axis 422 to close access door 410 as illustrated in FIG. 21.

Figure 22:
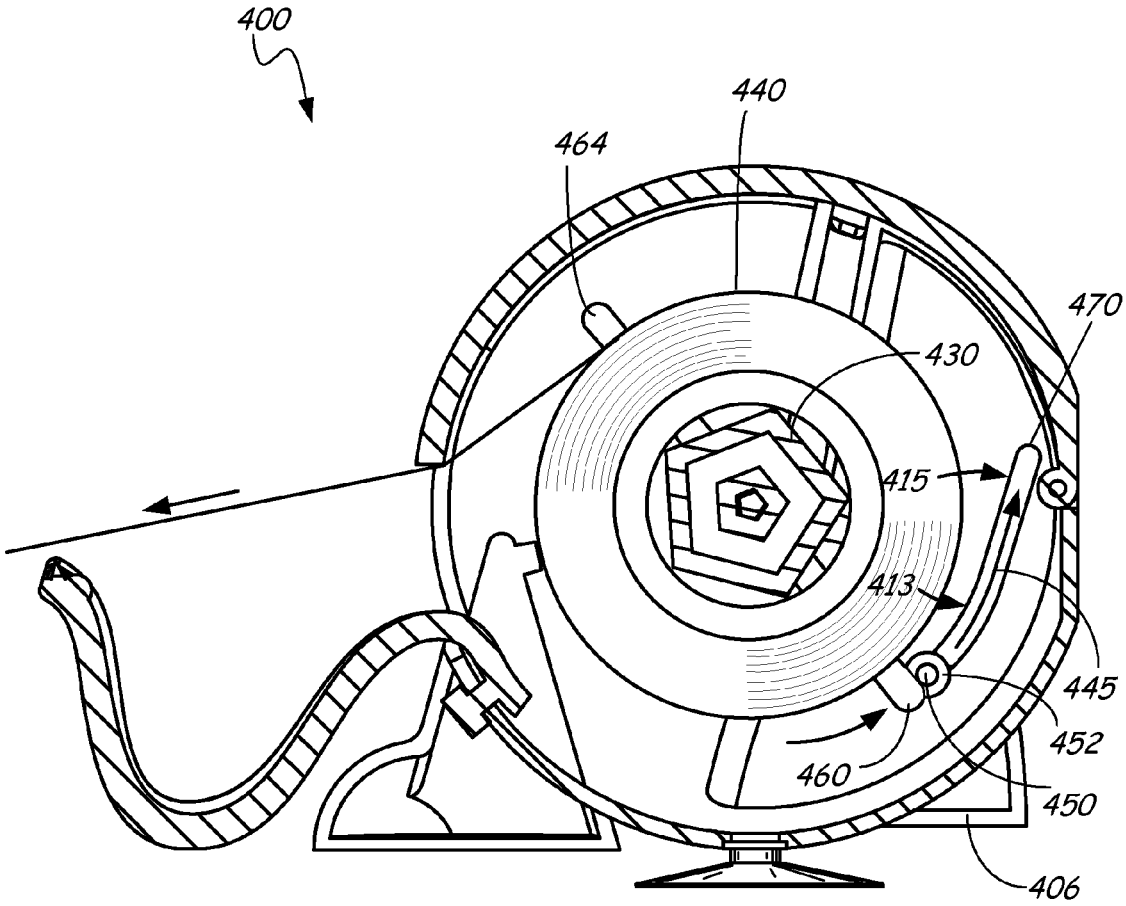
FIGS. 22-23 illustrate section views of animating animal legs coupled to a main body of the animated tape dispenser when dispensing tape.
Figure 23:
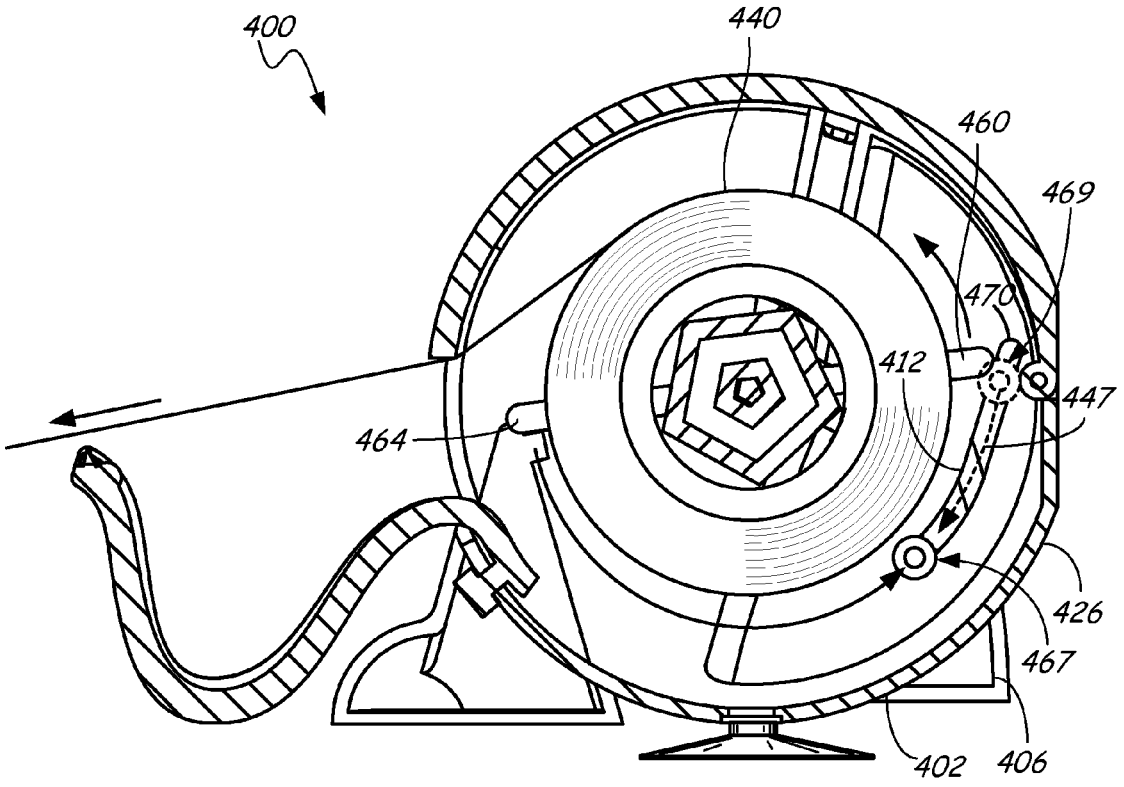

FIGS. 22-23 are section views illustrating the animation or actuation of rear animal legs 406 of the animated tape dispenser 400 when dispensing tape from the spool of adhesive tape 440. Rear animal legs 406 (of which only one is illustrated in FIGS. 19-23) include a first portion or a post 450 located within an interior of the main body 402 and a second portion extending outwardly from the exterior surface 426 of main body 402. Each post 450 is coupled to main body 402 through a channel opening 412 (of which only one is illustrated in FIGS. 19-23) by a fastener 452 (also illustrated in FIG. 19). The coupling of post 450 and fastener 452 to channel opening 412 is such that each post 450 is slidably movable within channel opening 412 and slidably movable along curved portion 413 and the linear portion 415 of channel opening 412.

Upon dispensing tape from the spool of adhesive tape 440, spool receiver 430, which is coupled to first elongated member 436 and second elongated member 438 via axial member 434, rotates about central axis 431. The rotation of spool receiver 430 rotates axial member 434 and first and second elongated members 436 and 438 because axial member 434 is fixedly coupled to spool receiver 430 and elongated members 436 and 438 are fixedly coupled to the axial member 434.

As elongated members 436 and 438 angularly rotate, one of their first ends 460, 462 and second ends 464 and 466 are configured to engage with the posts 450 of rear animal legs 406 to move or actuate the posts 450 and therefore the rear animal legs 406 relative to and along the exterior surface 426 of main body 402. More specifically and as shown by the directional arrow 445 in FIG. 23, posts 450 and therefore rear animal legs 406 slide from a first position 467 to a second position 469 along channel openings 412. While first position 467 is illustrated as being adjacent a first end 468 of channel opening 412 and second position 469 is illustrated as being adjacent a second end 470 of channel opening 412, first and second positions 467 and 469 can be located anywhere along channel opening 412 as long as the first position 467 is located below second position 469.

As the ends (for example end 460 as illustrated in FIG. 23) of elongated members 436 and 438 near second position 4769 of channel openings 412, elongated members 436 and 437 disengage from post 450 allowing rear animal legs 406 to slide back down to first end 468 of channel openings 412 via gravity as illustrated by directional arrow 447 in FIG. 23. As elongated members 436 and 438 continue to rotate because tape is being dispensed, second ends 464 and 466 will engage with post 450 and move or actuate the posts 450 and therefore the rear animal legs 406 relative to and along the exterior surface 426 of main body 402. As long as tape is being dispensed from the spool of adhesive tape 440, elongated members 436 and 438 will continue to radially rotate and engage with and disengage with rear animal legs 406. When tape is not being dispensed from the spool of adhesive tape 440, elongated members will discontinue radially rotating and therefore discontinue actuating rear animal legs 406.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A tape dispenser comprising:

a housing having an outer surface and configured to contain a roll of adhesive tape; and at least one animal leg coupled to the housing and extending outwardly from the outer surface of the housing;

wherein the at least one animal leg moves relative to the outer surface of the housing upon adhesive tape being dispensed from the roll of adhesive tape.

2. The tape dispenser of claim 1, wherein the at least one animal leg comprises a pair of animal legs.

3. The tape dispenser of claim 1, further comprising a spool receiving assembly including a spool receiver having a central axis and configured to receive the roll of adhesive tape, an axial member fixedly coupled to the spool receiver at the central axis and rotatably coupled to an interior of the housing and at least one elongated member fixedly coupled along the axial member adjacent the spool receiver.

4. The tape dispenser of claim 3, wherein the at least one elongated member has a first end and a second end, wherein the first and second ends are configured to engage with the at least one animal leg to move the at least one animal leg relative to the outer surface of the housing.

5. The tape dispenser of claim 4, wherein the housing comprises at least one channel opening through which the at least one animal leg is secured to the housing, wherein a first portion of the at least one animal leg is located within an interior of the housing and engages with the at least one elongated member and a second portion of the at least one animal leg extends outwardly from the outer surface of the housing.

6. The tape dispenser of claim 5, wherein the at least one elongated member engages with the first portion of the at least one animal leg to move the first portion along the at least one channel from a first position to a second position, wherein the second position is located above the first position.

7. The tape dispenser of claim 6, wherein the at least one channel opening comprises a first end located below a second end, wherein the at least one elongated member disengages from the first portion of the at least one animal leg when the first portion of the at least one animal is adjacent the second end.

8. The tape dispenser of claim 1, further comprising an access door having a proximal end and a distal end, wherein the proximal end is pivotally coupled to the housing.

9. The tape dispenser of claim 1, further comprising an animal tongue having a proximal end coupled to the housing and a distal end, the distal end including a cutting surface for cutting pieces of the adhesive tape.

10. A tape dispenser comprising:

a main body having an exterior surface;

at least one feature extending outwardly from the exterior surface of the main body and being slidably secured to the main body through a channel opening in the main body;

a spool receiving assembly comprising:

a spool receiver having a central axis and configured to receive a spool of adhesive tape;

an axial member rotatably coupled to the main body of the tape dispenser at first and second ends and fixedly coupled to the spool receiver at the central axis;

at least one elongated member fixedly coupled along the axial member between the spool receiver and one of the first and second ends of the axial member, the at least one elongated member having a first end and a second end; and wherein the first and second ends of the at least one elongated member are configured to engage with the at least one feature to slide the at least one feature from a first position along the channel opening to a second position along the channel opening.

11. The tape dispenser of claim 10, wherein the axial member axially rotates upon the spool receiver rotating about its central axis.

12. The tape dispenser of claim 10, wherein the at least one feature comprises an animal leg.

13. The tape dispenser of claim 10, wherein the at least one feature comprises a pair of animal legs.

14. The tape dispenser of claim 10, wherein the first position along the channel opening is located below the second position along the channel opening.

15. The tape dispenser of claim 10, wherein the first and second ends of the at least one elongated member are configured to disengage from the at least one feature at the second position.

16. The tape dispenser of claim 15, wherein the at least one feature slides from the second position to the first position when the at least one elongated member disengages from the at least one feature.

17. The tape dispenser of claim 10, wherein the channel opening comprises first and second ends, wherein the at least one elongated member is configured to disengage from the at least one feature when the at least one feature is located adjacent the second end of the channel opening.

18. A tape dispenser comprising:

a spool of adhesive tape mounted to a spool receiving assembly;

a housing for accommodating the spool receiving assembly such that the spool receiving assembly is rotatably coupled to an interior of the housing;

at least one decorative feature extending outwardly from an outer surface of the housing and being slidably secured to the main body through a channel opening in the housing;

wherein a portion of the spool receiving assembly engages with and actuates the at least one decorative feature to actuate the at least one decorative feature from a first position along the channel opening to a second position along the channel opening.

19. The tape dispenser of claim 18, wherein the spool receiving assembly comprises:

a spool receiver having a central axis;

an axial member fixedly coupled to the spool receiver at the central axis; and at least one elongated member fixedly coupled along the axial member and adjacent the spool receiver.

20. The tape dispenser of claim 19, wherein the at least one elongated member engages with and actuates the at least one decorative feature.

* * * * *